US007255340B2

(12) United States Patent
Anezaki et al.

(10) Patent No.: US 7,255,340 B2
(45) Date of Patent: Aug. 14, 2007

(54) SHEET STACK EJECTING APPARATUS, IMAGE FORMING APPARATUS, AND SHEET STACK PROCESSING APPARATUS

(75) Inventors: Tsutomu Anezaki, Toyokawa (JP); Riichi Hama, Hoi-gun (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 403 days.

(21) Appl. No.: 10/810,846

(22) Filed: Mar. 29, 2004

(65) Prior Publication Data

US 2005/0017444 A1 Jan. 27, 2005

(30) Foreign Application Priority Data

Jul. 16, 2003 (JP) ..... 2003-197706

(51) Int. Cl.
*B65H 43/00* (2006.01)

(52) U.S. Cl. ..... 271/176; 271/273; 271/207; 270/58.11

(58) Field of Classification Search ..... 270/58.11; 271/273, 274, 176, 207, 182, 134, 314
See application file for complete search history.

(56) References Cited

U.S. PATENT DOCUMENTS 4,826,383 A * 5/1989 Millen ..... 414/789.9
6,047,960 A * 4/2000 Kawano et al. ..... 271/184
6,244,583 B1 * 6/2001 Ohmichi et al. ..... 270/58.09
6,305,681 B1 * 10/2001 Watanabe et al. ..... 270/58.08
6,666,444 B1 * 12/2003 Paoli ..... 270/58.11
6,802,501 B2 * 10/2004 Boss et al. ..... 270/58.07
6,889,971 B2 * 5/2005 Tamura et al. ..... 270/58.11
6,942,206 B2 * 9/2005 Kuwata et al. ..... 270/58.08
6,962,331 B2 * 11/2005 Matsumoto et al. ..... 270/58.09

(Continued)

FOREIGN PATENT DOCUMENTS

JP 56-113606 1/1980

(Continued)

OTHER PUBLICATIONS

Japanese Notification of Ground for Rejection mailed on Aug. 16, 2005.

*Primary Examiner*—Patrick Mackey
*Assistant Examiner*—Michael C McCullough
(74) *Attorney, Agent, or Firm*—Morrison & Foerster LLP

(57) ABSTRACT

It is intended to provide a sheet stack ejecting apparatus, an image forming apparatus and a sheet stack processing apparatus applicable to ejection of a sheet stack while ejection errors are prevented by reducing disorderliness of ejected sheets of paper. A sheet ejecting apparatus 10 carries and ejects a sheet stack by holding the sheet stack with an ejecting roller pair 10 that consists of a top roller 21 and a bottom roller 22. The sheet ejecting apparatus 10 further includes a motor 24 for shifting the top roller 21 to switch between pressing state and separated state with respect to the ejecting roller pair 15 and a controller 20 for controlling the motor 24. The controller 20 works as ejection means that makes the ejecting roller pair 15 pressing state so as to eject a sheet stack and as separation means that makes the ejecting roller pair 15 separated state before a back end of a sheet stack escapes from nips of the ejecting roller pair 15 by using the motor 24.

20 Claims, 7 Drawing Sheets

U.S. PATENT DOCUMENTS

| | | | | |
|---|---|---|---|---|
| 6,978,990 | B2 * | 12/2005 | Silverbrook | 270/58.07 |
| 6,994,339 | B2 * | 2/2006 | Kato et al. | 270/58.12 |
| 7,000,912 | B2 * | 2/2006 | Tamura et al. | 270/58.11 |
| 7,152,860 | B2 * | 12/2006 | Silverbrook | 271/207 |
| 2003/0082029 | A1 * | 5/2003 | Silverbrook | 412/8 |
| 2004/0080739 | A1 * | 4/2004 | Sekiyama et al. | 355/407 |
| 2004/0104528 | A1 * | 6/2004 | Fukatsu et al. | 271/207 |
| 2004/0181308 | A1 * | 9/2004 | Hayashi et al. | 700/223 |
| 2005/0133991 | A1 * | 6/2005 | Ata et al. | 271/273 |
| 2006/0071423 | A1 * | 4/2006 | Ata et al. | 271/303 |

FOREIGN PATENT DOCUMENTS

| | | | |
|---|---|---|---|
| JP | 04055258 | A * | 2/1992 |
| JP | 6-278934 | A | 10/1994 |
| JP | 9-227014 | A | 9/1997 |
| JP | 11-255390 | | 9/1999 |
| JP | 2003-054805 | | 2/2003 |

* cited by examiner

SHEET STACK EJECTING APPARATUS, IMAGE FORMING APPARATUS, AND SHEET STACK PROCESSING APPARATUS

This application is based on Application No. 2003-197706 filed in Japan, contents of which is hereby incorporated by reference.

BACKGROUND OF THE INVENTION

1. Field of the Invention

The present invention relates to a sheet stack ejecting apparatus for ejecting a sheet of paper on which an image is formed by an image forming apparatus such as a copier, printer, and the like, an image forming apparatus, and a sheet stack processing apparatus. More particularly, it relates to a sheet stack ejecting apparatus for ejecting a sheet stack, namely, a plurality of sheets of paper which are stacked, an image forming apparatus, and a sheet stack processing apparatus.

2. Description of Related Art

In various types of image forming apparatus generally, sheets of paper on which images have been formed are held and carried by rotating members such as an ejecting roller, an ejecting belt, and the like, and then, piled up on an ejected sheet holding tray arranged at downstream side of the rotating members with back ends of the sheets of paper being met with a back plate of the tray. For recent years, sheet ejection speed has become faster along with improvement of operation speed of respective sections in an image forming apparatus. Therefore, there has arisen a problem such that ejected sheets of paper on an ejected sheet holding tray are not piled up neatly. If sheet ejection is slowed down, disorderliness of sheet piling is reduced. However, operation efficiency as the entirety of the image forming apparatus goes down. As countermeasure of such a problem, there has been proposed a sheet ejecting apparatus that can lower rotation speed of an ejecting roller in the middle of ejections by detecting a back end of a sheet (for example, see Japanese Laid-open Patent Publication No. 11-255390). According to this type of sheet ejecting apparatus, sheet ejection speed slows down when a back end of a sheet passes through a nip of an ejecting roller. Since sheet ejection speed slows down when a sheet of paper is ejected to the ejected sheet holding tray, disorderliness of ejected sheets of paper is reduced.

On the other hand, there are some image forming apparatuses provided with a post-processing apparatus that conducts post-processing to sheets of paper on which an image has been formed. In such an image forming apparatus, plural of sheets of paper are piled up to make a sheet stack and ejected through post-processing such as stapling on the sheet stack, for example.

In case of ejecting a sheet stack also, ejection speed is so fast that a sheet stack hops out from an ejection slot vigorously and sometimes does not return to an backboard of an ejected sheet holding tray. Especially, in case of ejecting significant number of sheet stacks, sheet stacks ejected are piled up on an ejected sheet holding tray and sometimes sheet stacks hopping out too much are mounted on near the top of the pile. When such a situation arises, a back end of a sheet stack stays at the vicinity of an ejection slot and a front end of a next sheet stack bumps against the back end of the precedent sheet stack, which could cause an ejection error, and a paper jam.

However, the conventional sheet ejecting apparatus previously described is suitable for ejection operation to eject sheets one by one. In case ejection manner of the conventional apparatus is applied to ejection of sheet stacks, rotation speed of the ejecting roller must be changed in the middle of ejection operation. As a result, out of sheets belonging to a sheet stack, a top sheet and a bottom sheet in contact with rollers receive load. This aspect can cause disorderliness of a sheet stack, and wrinkles on sheets of paper, which are problematic.

SUMMARY OF THE INVENTION

The present invention has been made in order to solve the foregoing problem. It is an object of the present invention to provide a sheet stack ejecting apparatus, an image forming apparatus and a sheet stack processing apparatus applicable to ejection of a sheet stack while ejection errors are prevented by reducing disorderliness of ejected sheets of paper.

To solve the above described problems, there is provided a sheet stack ejecting apparatus comprising: an ejecting device for carrying and ejecting a sheet stack, the ejecting device holding a sheet stack with two rotating members to carry the sheet stack; an open-close mechanism for switching states of the two rotating members by shifting at least one of the two rotating members to adjust pressing force, the open-close mechanism switching between a contact and pressing state and a pressing-force weakened state; and a controller for controlling the open-close mechanism that makes the two rotating members a contact and pressing state by the open-close mechanism when a sheet stack is ejected, and makes the two rotating members a pressing-force weakened state before a back end of the sheet stack escapes from nips of the two rotating members.

According to the inventive sheet stack ejecting apparatus, a sheet stack held by the two rotating members in a contact and pressing state is ejected by the ejecting device. At least one of the two rotating members is shifted by the open-close mechanism so as to switch between a contact and pressing state and a pressing-force weakened state. Furthermore, pressing force of the two rotating members is weakened or the two rotating members are separated before a back end of a sheet stack escapes from a nip of the two rotating members. Therefore, after it is switched to a pressing-force weakened state, the sheet stack is ejected by inertia of its own. Therefore, speed of the sheet stack after switching slows down gradually due to friction with peripheral things. Thereby, there is provided a sheet stack ejecting apparatus applicable to ejection of a sheet stack while ejection errors are prevented by reducing disorderliness of ejected sheets of paper.

According to the present invention, there is also provided an image forming apparatus comprising: an image forming section for forming an image on a sheet of paper; a processing tray for storing sheets of paper on which images have been formed by the image forming section and making a sheet stack; and a sheet stack ejecting apparatus for carrying and ejecting a sheet stack taken out from the processing tray, the sheet stack ejecting apparatus holding a sheet stack with two rotating members to carry the sheet stack, wherein the sheet stack ejecting apparatus comprises: an ejecting device for carrying and ejecting a sheet stack, the ejecting device holding a sheet stack with two rotating members to carry the sheet stack; an open-close mechanism for switching states of the two rotating members by shifting at least one of the two rotating members to adjust pressing force, the open-close mechanism switching between a contact and pressing state and a pressing-force weakened state; and a controller for controlling the open-close mechanism that makes the two rotating members a contact and pressing state by the open-close mechanism when a sheet stack is ejected, and makes the two rotating members a pressing-force weakened state before a back end of the sheet stack escapes from nips of the two rotating members.

According to the present invention, there is also provided a sheet stack processing apparatus comprising: a processing tray for storing plural sheets of paper in order and making a sheet stack; an ejecting device for carrying and ejecting a sheet stack piled on the processing tray, the ejecting device holding a sheet stack with two rotating members to carry the sheet stack; a stack processing device for conducting stack processing to a sheet stack piled on the processing tray before the sheet stack is ejected by the ejecting device; an open-close mechanism for switching states of the two rotating members by shifting at least one of the two rotating members to adjust pressing force, the open-close mechanism switching between a contact and pressing state and a pressing-force weakened state; and a controller for controlling the open-close mechanism that makes the two rotating members a contact and pressing state by the open-close mechanism when a sheet stack is ejected, and makes the two rotating members a pressing-force weakened state before a back end of the sheet stack escapes from nips of the two rotating members.

The above and further objects and novel features of the invention will more fully appear from the following detailed description when the same is read n connection with the accompanying drawings. It is to be expressly understood, however, that the drawings are for the purpose of illustration only and are not intended as a definition of the limits of the invention.

BRIEF DESCRIPTION OF DRAWINGS

For a better understanding of the present invention, reference is made to the following detailed description of the invention, just in conjunction with the accompanying drawings in which.

DETAILED DESCRIPTION OF PREFERRED EMBODIMENTS

Figure 1:
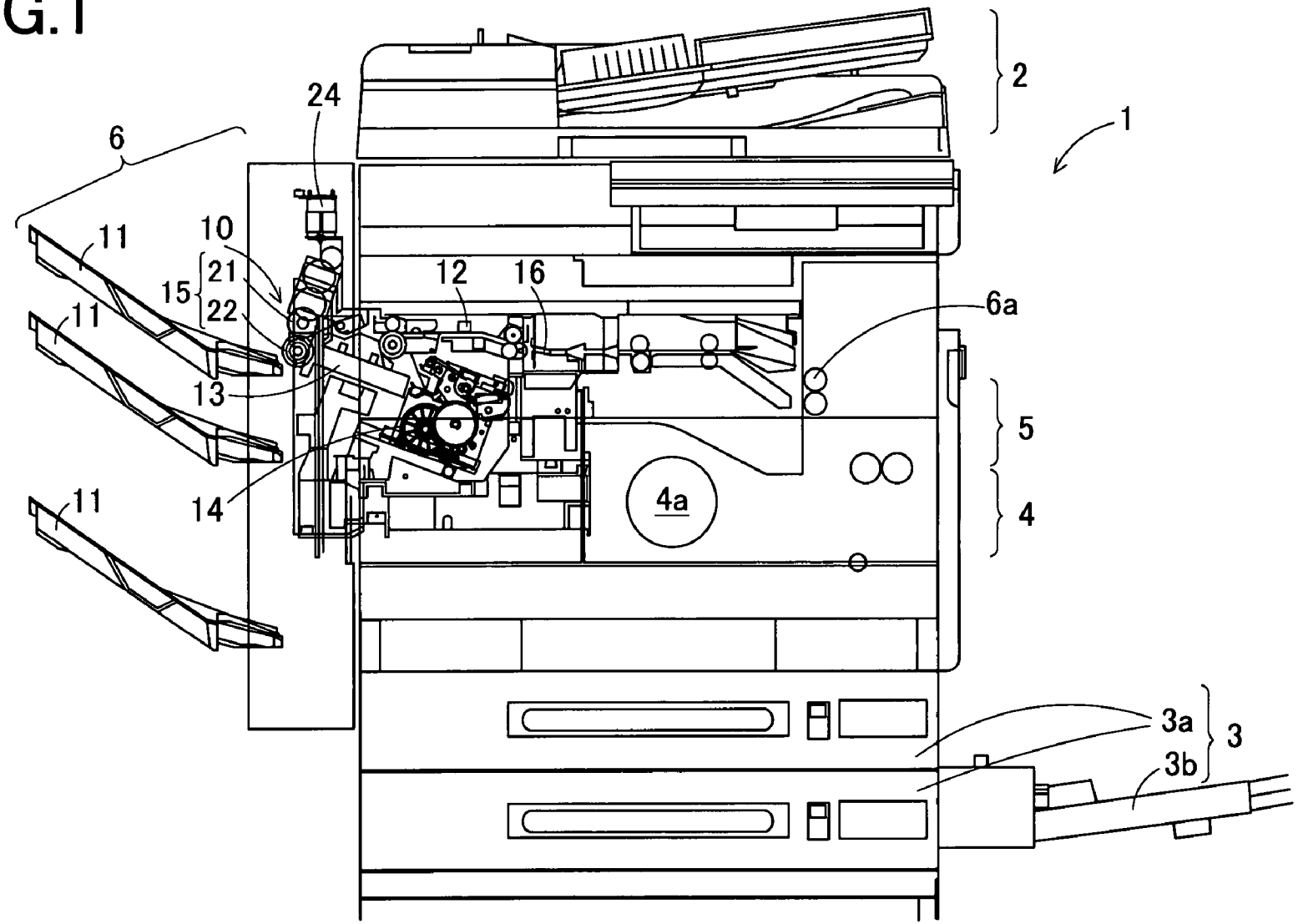
FIG. 1 is a cross sectional view showing schematic structure of an image forming apparatus of the present embodiment.

An embodiment of the present invention will be described by referring to the accompanying drawings. In the embodiment, the present invention is applied to a sheet ejecting apparatus 10 incorporated in an image forming apparatus 1 shown in FIG. 1. The image forming apparatus 1 is a multifunction printer including copier function and printer function.

Firstly, the image forming apparatus 1 will be briefly described. The image forming apparatus 1 comprises a reading section 2, a sheet feeding section 3 (two sheet feeding cassettes 3*a* and a manually-sheet-inserting tray 3*b*), an imaging section 4 consisting of a photosensitive body 4*a*, a fixing section 5, and a sheet ejecting section 6 (a main-body ejecting roller 6*a*, a sheet ejecting apparatus 10 and an ejected sheet holding tray 11). In case the image forming apparatus 1 works as a copier, an image of a document is read by the reading section 2 to obtain image data. In case it works as a printer, image data is transmitted from a personal computer or the like. A sheet of paper for image formation is fed from any one of the sheet feeding cassettes 3*a* or the manually-sheet-inserting tray 3*b* one by one. In the image forming section 4, an image is formed on a sheet of paper fed from the sheet feeding section 3 basing on image data. Furthermore, a toner image formed on the sheet is fixed by the fixing section 5, and the sheet is ejected to the sheet ejecting section 6 by the main-body ejecting roller 6*a*.

Figure 2:
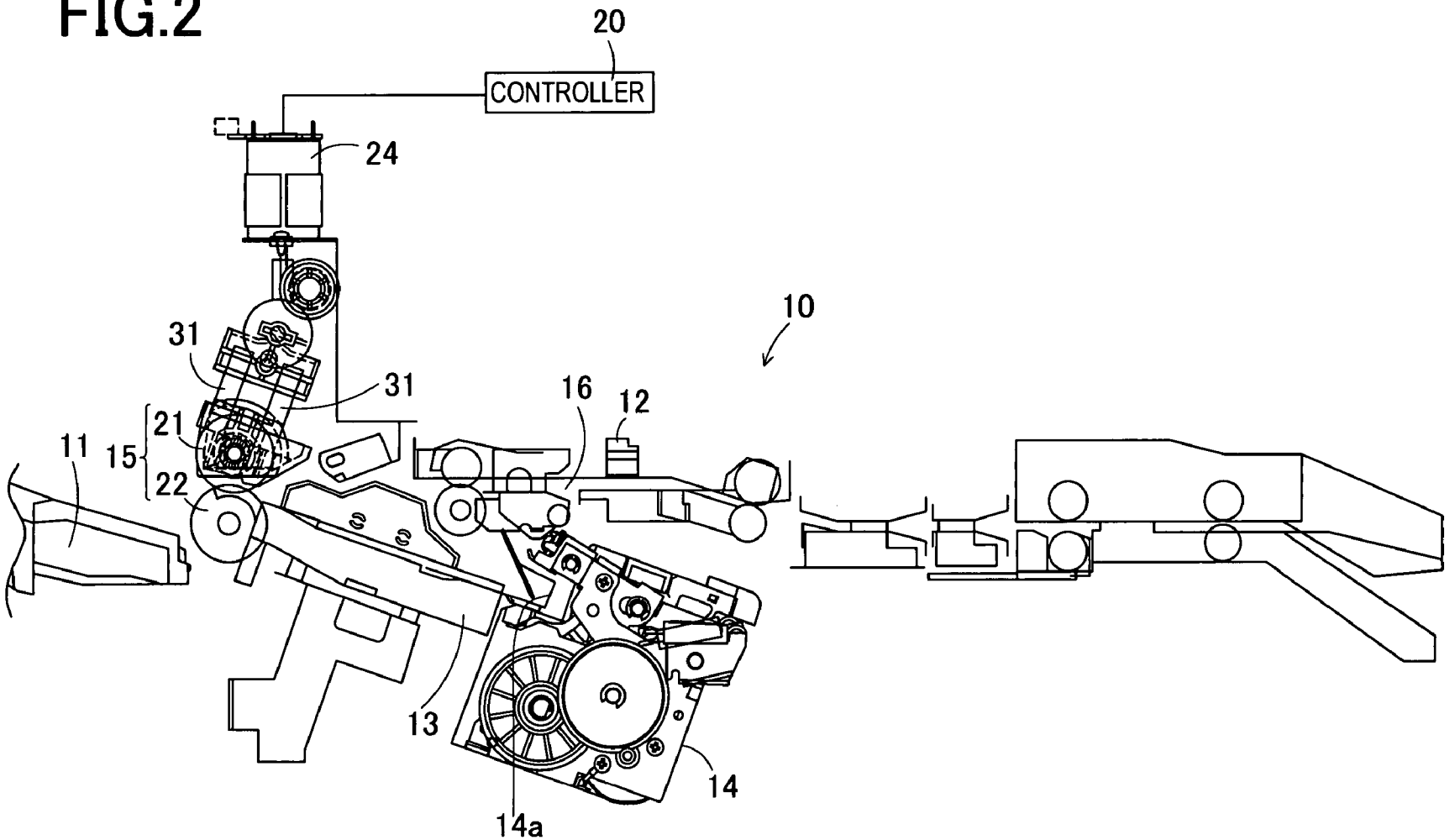
FIG. 2 is a front view showing schematic structure of a sheet ejecting apparatus.

As shown in FIG. 1 and FIG. 2, the sheet ejecting apparatus 10 in the sheet ejecting section 6 is arranged at downstream side of a sheet carrying direction for the main-body ejection roller, and ejects the sheet on which the formed image has been fixed out to the ejected sheet holding tray 11. In the sheet ejecting apparatus 10, a sensor 12, a processing tray 13, a processing section 14, an ejecting roller pair 15 and the like are arranged. There is a sheet ejecting path 16 reaching the ejected sheet holding tray 11 through the above mechanic items.

The sensor 12 detects a sheet of paper carried through the sheet ejecting path 16. The processing tray 13 and the processing section 14 make a process to plural sheets of printed paper so as to make a sheet stack. Therefore, they are not used for ejecting sheets one by one. In the processing section 14, there is formed a receiving space 14*a* to which an end portion of each sheet to be made in a sheet stack is inserted. The processing tray 13 is attached slantingly toward the receiving space 14*a* so as to lead ends of sheets piled there to the processing section 14.

Figure 3:
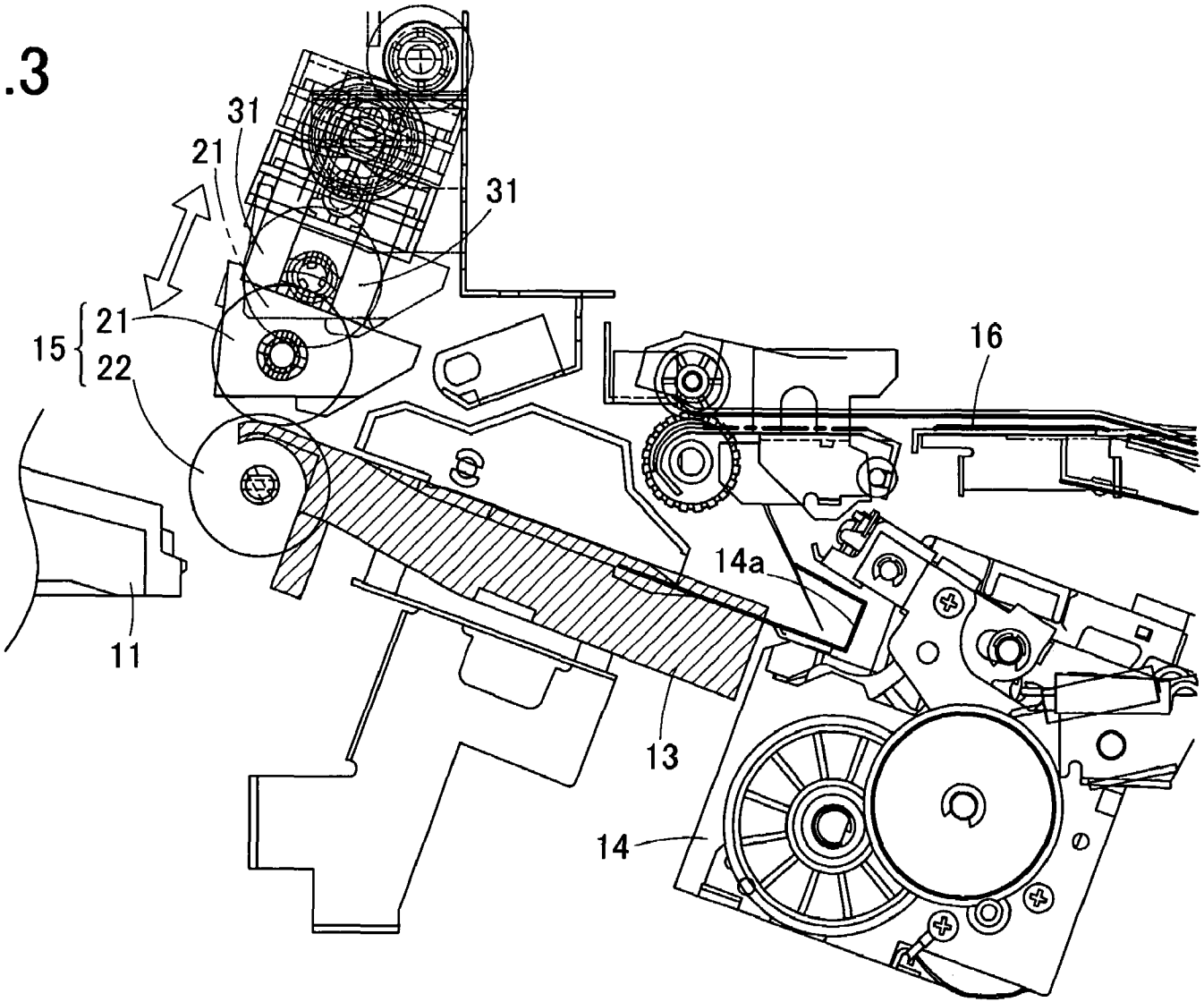
FIG. 3 is a partial structure view showing schematic structure of the sheet ejecting apparatus.

The ejecting roller pair 15 ejects a sheet of paper or a sheet stack to the ejected sheet holding tray 11. As shown in FIG. 2 and FIG. 3, the ejecting roller pair 15 is structured such that a top roller 21 and a bottom roller 22 are arranged facing each other. Those rollers rotate holding a sheet of paper to be ejected, whereby the sheet is ejected out. Elastic force of a spring member 31 is applied to the top roller 21 to make the top roller 21 pressingly contact with the bottom roller 22, whereby various thickness of paper, from a sheet of paper to a sheet stack, can be ejected. In this embodiment, the bottom roller 22 is a driving roller and the top roller 21 is a driven roller. However, the top roller 21 maybe designed as a driving roller.

Furthermore, the sheet ejecting apparatus 10 is provided with a motor 24 for shifting the top roller 21. Rotation angle of a rotating shaft for the motor 24 is controlled by the controller 20. Thereby, the top roller 21 is movable in height direction slanting a little, as shown in FIG. 3. This mechanism enables the top roller 21 and the bottom roller 22 to be in a contact and pressing state or contact-and-pressing-free state (separated state).

Figure 4:
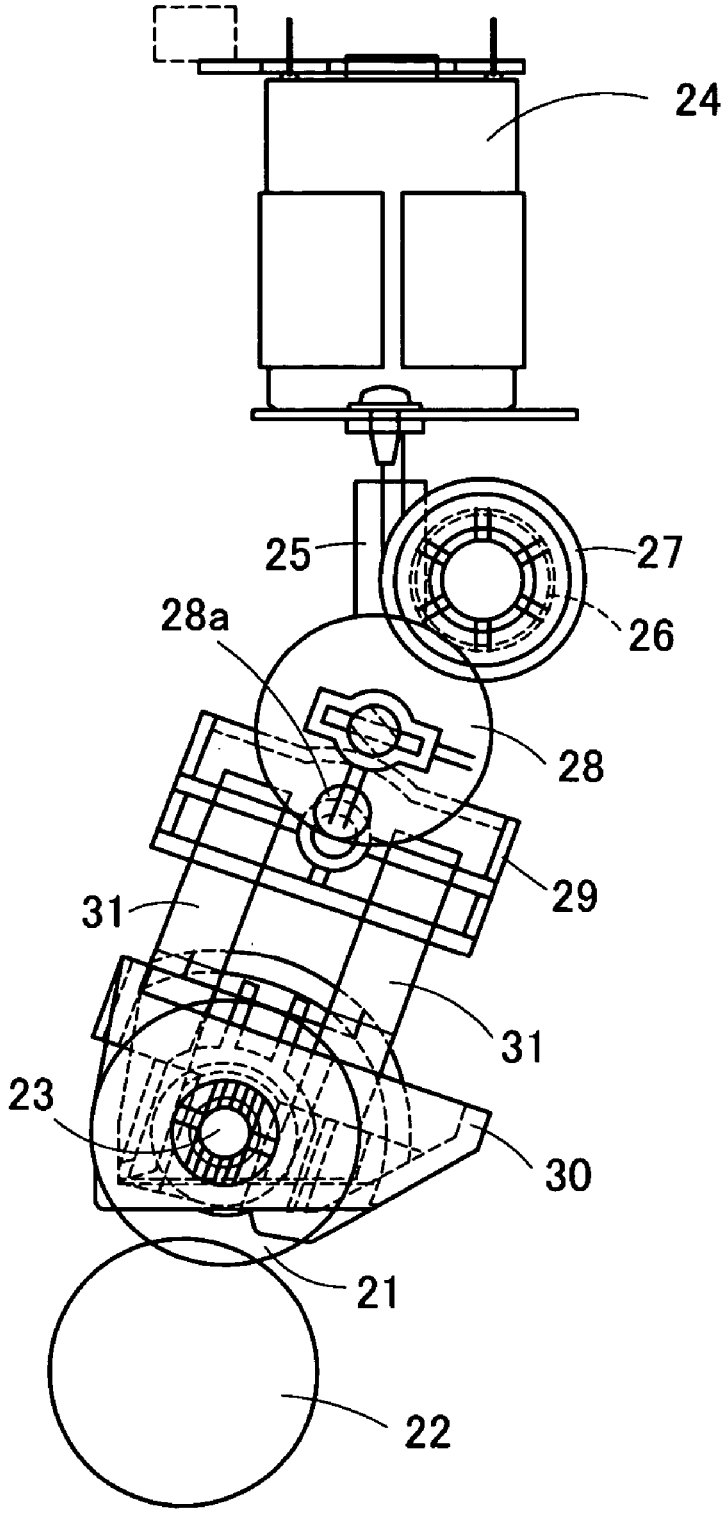
FIG. 4 is a front view showing a state that a top roller is pressed and in contact with a bottom roller in the sheet ejecting apparatus.
Figure 5:
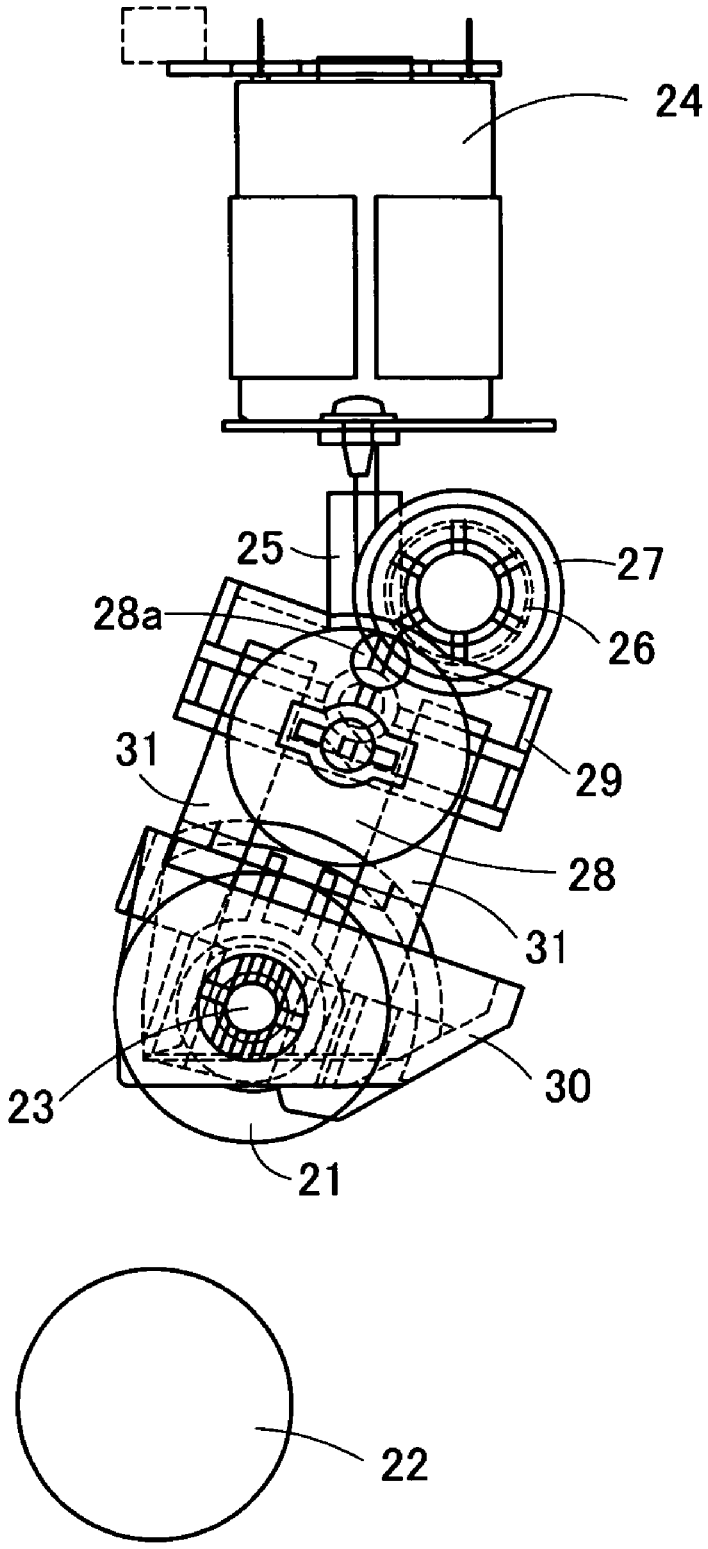
FIG. 5 is a front view showing a state that the top roller is separated from the bottom roller in the sheet ejecting apparatus.
Figure 6:
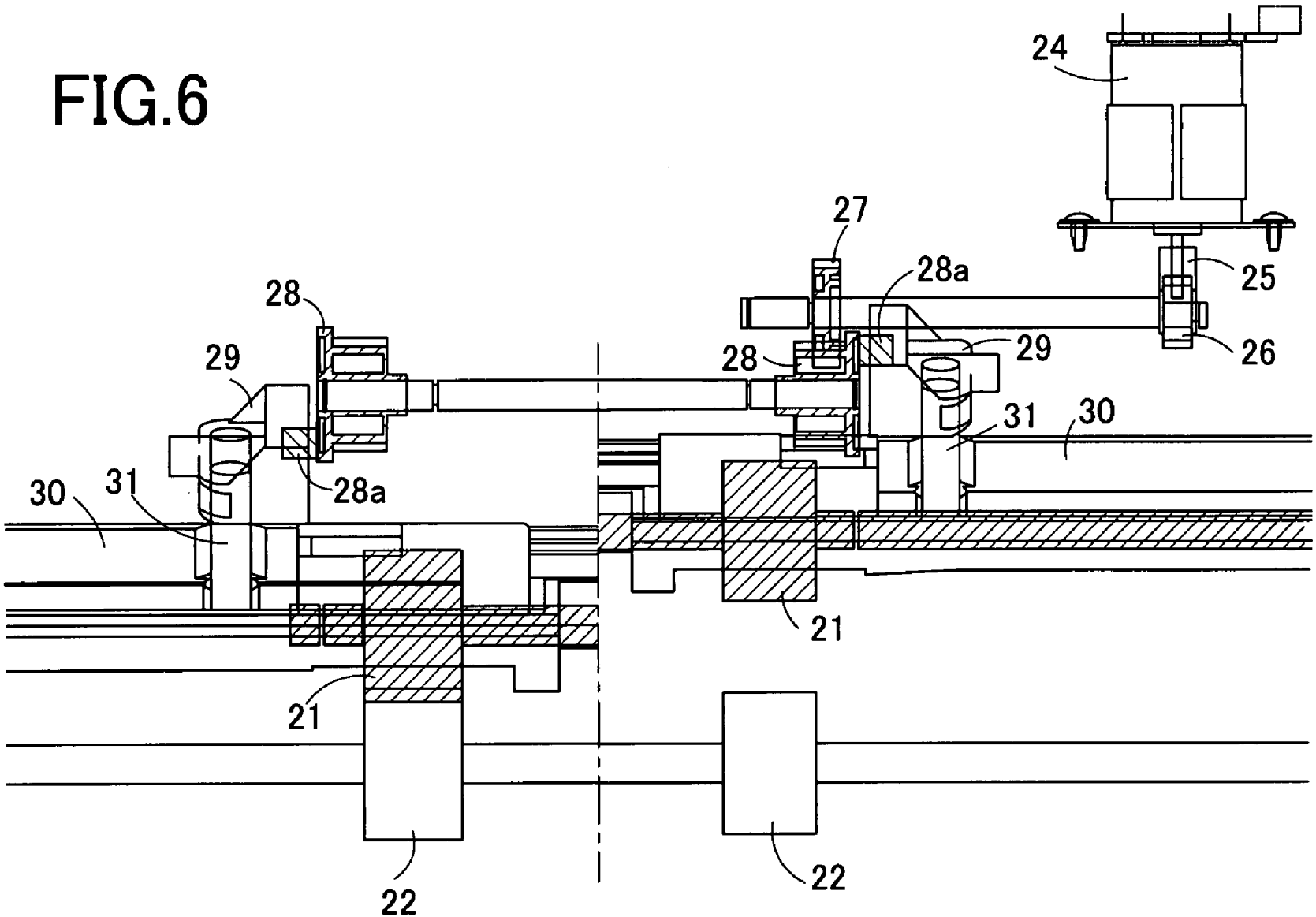
FIG. 6 is a side view showing schematic structure of a portion of an ejecting roller pair in the sheet ejecting apparatus.

Next, there will be described a driving portion for driving the top roller up and down. As shown in FIG. 4 and FIG. 5, the top roller 21 is held rotatably around the rotating shaft 23. According to the drawings, the entire of the top roller 21 including the rotating shaft moves up and down, whereby the top roller 21 can contact with and separate from the bottom roller 22. The bottom roller 22 is rotated and driven but not shifted. FIG. 4 shows a state that the top roller 21 is in contact with the bottom roller 22 to which pressing force is applied. FIG. 5 shows a state that the top roller 21 separates from the bottom roller 22. FIG. 6 shows a right side view of FIG. 4 and FIG. 5. In FIG. 6, the left half shows a contact and pressing state whereas the right half shows a separated state.

As shown in those figures, the top roller 21 is shifted by the motor 24 and for transmitting rotation of the motor 24 to the top roller 21, a worm 25, a first gear 26, a second gear 27, a rotating member 28, and a moving member 29 are arranged. The worm 25 is attached to the rotating shaft of the motor 24. The worm 25 and the first gear 26 bite each other to change rotating direction. The first gear 26 and the second gear 27 are arranged on the same axis. Therefore, they rotate in same direction. Furthermore, since the second gear 27 and the rotating member 28 bite each other, rotation of the second gear 27 is transmitted as rotation of the rotating member 28. Furthermore, the rotating member 28 has a height 28*a*. This height 28*a* is provided so as to allow the moving member 29 to rotate and slide to some extent. Still further, a guide 30 is fixed to the rotating shaft 23 for the top roller 21, and the guide 30 and the moving member 29 are connected with a spring member 31 stretchably.

Cooperative movement of those transmits rotation of the rotating shaft for the motor 24 to the rotating member 28 through the first gear 26 and the second gear 27, whereby the rotating member 28 rotates. When the rotating member 28 rotates half, the height 28*a* moves drawing a semicircle and the moving member 29 moves from a state of FIG. 4 to a state of FIG. 5 or vice versa. Movement of the moving member 29 is transmitted as movement of the guide 30 via the spring member 31. Since the guide 30 is attached to the rotating shaft 23, the rotating shaft 23 moves together with the guide 30. Accordingly, the top roller 21 attached to the rotating shaft 23 is moved up and down in the drawing wherein rotation angle of the motor 24 is controlled by the controller 20 (see FIG. 2).

Next, there will be described ejection operation of the ejecting roller pair 15 including such movable top roller 21. As shown in FIG. 1 and FIG. 2, sheets of paper ejected from the main-body ejecting roller 6*a* go through the sheet ejecting path 16 and reach the ejecting roller pair 15 one by one. In case sheets of paper to be ejected are not made into a sheet stack, the top roller 21 and the bottom roller 22 of the ejecting roller pair 15 are driven and rotated with the both roller in a contact and pressing state. A sheet of paper receives force toward ejection direction with nips and is ejected to the ejected sheet holding tray 11.

On the other hand, in case sheets of paper to be ejected are made into a sheet stack, sheets carried from the main-body ejecting roller 6*a* to the sheet ejecting path 16 are piled up on the processing tray 13 in order. At this stage, rollers of the ejecting roller pair 15 are separated and rotation of the rollers is stopped. Each sheet to be made into a sheet stack is put on the processing tray 13 and back end portions of sheets are met by inserting the sheets into the receiving space 14*a* of the processing section 14. At this stage, front end portions of the sheets generally go through a space between separated ejecting roller pair 15 and poke out at the side of the ejected sheet holding tray 11. When all sheets to be made into a sheet stack are put on the processing tray 13, the processing section 14 conducts processing to make a sheet stack. As examples of such processing, there are raised stapling, paper punching, clipping, and the like.

After sheets have been made into a sheet stack, the top roller 21 is moved downward to press the sheet stack with the bottom roller 22. Therefore, a front end portion of a sheet stack is held by the top roller 21 and the bottom roller 22. Since pressing force of the moving member 29 is transmitted to the top roller 21 via the spring member 31, the sheet stack is pressed with appropriate pressing force regardless of thickness of it. Furthermore, the bottom roller 22 is driven and rotated, whereby a sheet stack is ejected to the ejected sheet holding tray 11.

In a conventional sheet ejecting apparatus, a bottom roller kept on driving until a back end of a sheet stack passed through nips of the ejecting roller pair and further went forward by 10 mm or so. This 10 mm of movement is done for allowance. For letting the back end move by 10 mm, the bottom roller was rotated for 300 msec from beginning of rotation. In many sheet ejecting apparatus of this kind, a distance from the ejecting roller pair to a receiving space of a processing section was always constant. Therefore, through position of a sheet stack's back end could be grasped from rotation speed and time from beginning of rotation of the bottom roller. After rotation of 300 msec was done, rotation of the bottom roller was stopped and rollers of the ejecting roller pair were separated so as to deal with a next sheet stack.

On the other hand, in the sheet ejecting apparatus 10 of the present embodiment, pressing force of the ejecting roller pair 15 is weakened before rotation of 300 msec is done. Thereby, rollers are separated. After separation of the rollers, a sheet stack is carried by driving force transmitted from the bottom roller 22. However, since the sheet stack is not pressed with the top roller 21, carrying force given by the bottom roller 22 is weak. Thereby, this mechanism prevents a sheet stack from hopping out to the ejected sheet holding tray 11 vigorously without causing disorderliness of a sheet stack. Furthermore, since the rollers of the ejecting roller pair 15 are separated with timing earlier than the conventional ones, the ejecting roller pair 15 can get ready to receive next sheet stack. Accordingly, even when post-processing is conducted, processing speed as entirety of the image forming apparatus 1 does not lower. There can be a case a sheet stack can be carried by its own inertia even if rotation of the bottom roller 22 is stopped simultaneously with separation of the ejecting roller pair 15. In such case, the bottom roller 22 can be stopped in simultaneous with separation of the ejecting roller pair 15.

Figure 7:
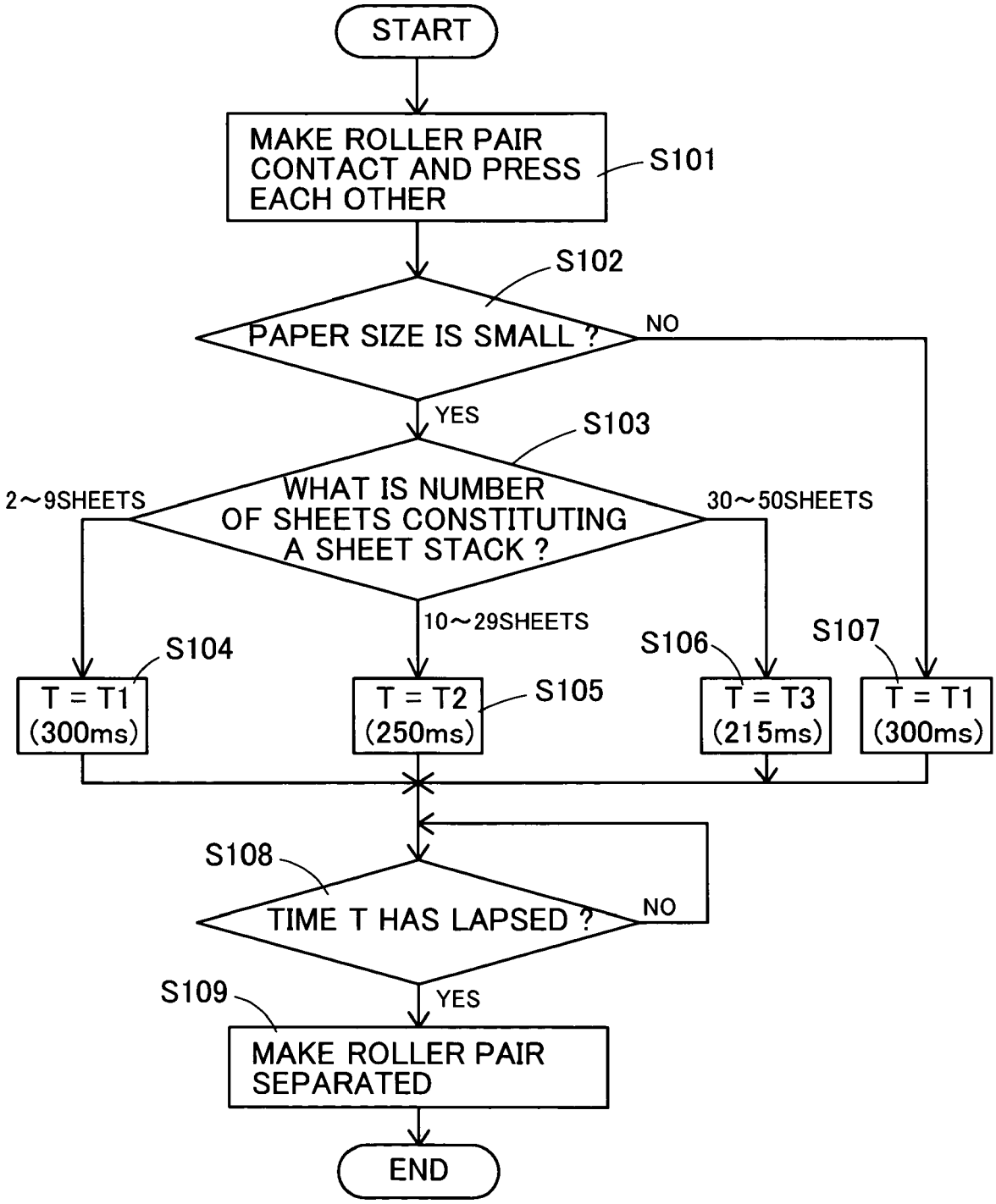
FIG. 7 is a flow chart showing operation of the sheet ejecting apparatus.

Next, pressing/separating operation of the ejecting roller pair 15 will be described by referring to a flow chart of FIG. 7. The processing of the flow chart is conducted after a sheet stack is made on the processing tray 13. Firstly of this processing, the top roller 21 is moved downward to make the ejecting roller pair 15 contact and press each other (S101) and then, driving of the bottom roller 22 is started. Thereby, the sheet stack is held by the ejecting roller pair 15 at a portion around front end and begins to be moved to an ejection direction along with rotation of the bottom roller 22.

Next, it is detected whether or not a size of each sheet constituting the sheet stack is smaller than a predetermined size (S102). That is, degree to occur disorderliness of ejected sheets differs depending on paper size. For example, it has been known experientially that disorderliness scarcely occurs in case a paper size is B4 (international standard paper size) or larger. In the sheet ejection apparatus 10, a distance from the ejecting roller pair 15 to the receiving section 14*a* for the processing section 14 is constant, and a front end of a large-sized sheet sticks out ahead the ejecting roller pair 15 more as a paper size is larger. Therefore, in case a paper size is a predetermined size or larger, the ejecting roller pair 15 is driven in accordance with the conventional manner. Generally, a paper size is grasped by the main body of the image forming apparatus 1. However, a paper size can be detected by the sensor 12. In case a sheet stack consists of plural sizes of sheets, a paper size of the sheet stack is regarded as the largest one. Furthermore, in case a sheet is a special size or a designated size, its size is judged with its length in a carrying direction.

In case a paper size of the sheet stack is judged larger than a predetermined size (S102: No), rotation time T of the bottom roller 22 is set to T1=300 msec, as a default value equivalent to conventional time setting (S107). "T" is a time that the ejecting roller pair 15 falls into a contact and pressing state to start driving till falling into a separated state. In case a paper size of a sheet stack is a small size (S102: Yes), time setting is determined depending on number of sheets constituting a sheet stack (S103). The number of sheets can be obtained from a controller in the main body of the image forming apparatus 1.

In case a sheet stack consists of small number of sheets 2 through 9, disorderliness of ejected sheets scarcely occurs. Therefore, time is set to T=T1 (300 msec) (processing goes on to S104). In case 10 through 29, it is set to T=T2 (250 msec), (goes on to S105). In case 30 through 50, it is set to T=T3 (215 msec), (goes on to S106). T2, i.e., 250 msec, corresponds to timing that a back end of a sheet stack comes to a point to reach the nips of the ejecting roller pair 15 by about 20 mm. T3, i.e., 215 msec, corresponds to timing that a back end portion comes to a point to reach the nips by about 40 mm.

Next, a stand-by state lasts from start of driving the bottom roller 22 till lapse of time T set at S104 through S107. After time T has lapsed (S108: Yes), the rollers of the ejecting roller pair 15 are separated in order not to transmit ejection force to a sheet stack (S109). Thereby, sheet stack ejection processing by the sheet ejecting apparatus 10 completes.

As described in the above, in the sheet ejecting apparatus 10 directed to the present invention, the top roller 21 is moved to be separated from the bottom roller 22 before a sheet stack thoroughly passes through the nips of the ejecting roller pair 15. Thereby, final ejection speed can be slowed without lowering processing speed as entirety of the image forming apparatus 1. Final ejection speed is slowed, whereby a back end portion of a sheet stack falls down around the back plate of the ejected sheet holding tray 11. As a result, disorderliness of ejected sheet stacks such that a sheet stack hops out vigorously, a sheet stack lands in the middle of the ejected sheet holding tray 11, and the like can be prevented. Accordingly, the inventive sheet ejection apparatus prevents ejection errors of a sheet stack by reducing disorderliness of ejected sheet stacks.

The above described embodiments are provided for mere illustrative purpose, and the present invention is not limited thereto. Of course, various modifications or variations can occur without departing the spirit of the invention.

For example, in the embodiment, the image forming apparatus 1 is defined to be a multi-function printer. However, the image forming apparatus 1 may be a copier or a simple printer. Furthermore, as long as it is an apparatus provided with post-processing function to make a sheet stack, types of printing methods including ink jet type do not matter and the image forming apparatus 1 is applicable to an apparatus not for printing but provided with post-processing function only. Furthermore, as to the ejecting roller pair 15, pressing and separation can be done by moving both the top roller 21 and the bottom roller 22.

Furthermore, although "300 msec", "250 msec" and the like are used as time from start of driving till separation of the ejection roller pair 15, those values are merely examples and it is not necessary to strictly follow those values. Furthermore, classification relating to number of sheets constituting a sheet stack such as "2 through 9" or the like that determines a value of time T is not limited to figures raised in the embodiment. Classification can be changed flexibly depending on various conditions. For example, an optimum value may be selected depending on structure of the sheet ejecting apparatus 10, an arrangement manner of the ejecting roller pair 15, and the like.

Furthermore, although separation timing of the ejecting roller pair 15 is determined by number of sheet constituting a sheet stack in the embodiment, the timing may be determined by using at least one of the followings: paper size; number of sheets; thickness of a sheet stack; and weight of a sheet stack. For example, the timing can be determined by a product of paper size and number of sheets. After the ejecting roller pair 15 is separated, a sheet stack is ejected out by its own inertia. Therefore, ejection speed is influenced by a paper size, number of sheets, thickness of a sheet stack, weight of a sheet stack, and the like. Therefore, at least one of the above conditions should be used to determine separation timing of the ejecting roller pair 15, whereby ejection speed suitable to the sheet stack can be obtained. For example, it is preferable that separation timing of the ejecting roller pair 15 should be made earlier as number of sheets is larger. That is, a weight of a sheet stack is heavier and its inertia is larger as larger the number of sheets constituting a sheet stack.

The ejecting roller pair 15 can be separated before a back end of a sheet stack escapes from the nips of the ejecting roller pair 15 only when a paper size is smaller than a predetermined size. For example, in case an apparatus can make back ends of sheet stacks meet at a predetermined position, a front end of a sheet stack paper size of which is large is put on with its front end sticking out very much from the nips of the ejecting roller pair 15 toward a carrying direction. Subsequently, the sticking-out portion becomes resistance and the sheet stack is hard to get much inertia.

Furthermore, for example, in case sheets not for a sheet stack are ejected, structure that those sheets do not pass through the ejecting roller pair 15 is acceptable.

Furthermore, the embodiment employs a roller as a rotating member for carrying means, however, a belt can be used as a rotating member instead of a roller.

As apparent from the foregoing description, the present invention provides a sheet stack ejecting apparatus, an image forming apparatus and a sheet stack processing apparatus applicable to ejection of a sheet stack while ejection errors are prevented by reducing disorderliness of ejected sheets of paper.

What is claimed is:

1. A sheet stack ejecting apparatus comprising:

an ejecting device for carrying and ejecting a sheet stack, the ejecting device holding a sheet stack with two rotating members to carry the sheet stack, wherein the sheet stack continues moving until completely ejected;

an open-close mechanism for switching states of the two rotating members by shifting at least one of the two rotating members to adjust pressing force, the open-close mechanism switching between a contact and pressing state and a contact-and-pressing free state; and a controller for controlling the open-close mechanism to be in the contact and pressing state when a sheet stack is ejected, and to be in the contact-and-pressing free state before a back end of the sheet stack escapes from nips of the two rotating members and to remain in the contact-and-pressing free state until the sheet stack is completely ejected.

2. A sheet stack ejecting apparatus according to claim 1, wherein the two rotating members are separated when the open-close mechanism controls the two rotating members to be in the contact-and-pressing free state.

3. A sheet stack ejecting apparatus according to claim 2, wherein the controller determines timing to separate the two rotating members by using at least one of following factors: paper size; number of sheets of paper; thickness of a sheet stack; and weight of a sheet stack.

4. A sheet stack ejecting apparatus according to claim 3, wherein the controller separates the two rotating members before a back end of a sheet of paper escapes from nips of the two rotating members only in case the paper size is a predetermined size or smaller.

5. A sheet stack ejecting apparatus according to claim 3, wherein the controller separates the two rotating members earlier as the number of sheets increases.

6. A sheet stack ejecting apparatus according to claim 5, wherein the controller separates the two rotating members before a back end of a sheet of paper escapes from nips of the two rotating members only in case number of sheets is a predetermined number or more.

7. A sheet stack ejecting apparatus according to claim 1, wherein the open-close mechanism comprises:

a moving member that moves along with opening/closing of the two rotating members; and an elastic member provided between one of the two rotating members and the moving member.

8. An image forming apparatus comprising:

an image forming section for forming an image on a sheet of paper;

a processing tray for storing sheets of paper on which images have been formed by the image forming section and making a sheet stack; and a sheet stack ejecting apparatus for carrying and ejecting a sheet stack taken out from the processing tray, the sheet stack ejecting apparatus holding a sheet stack with two rotating members to carry the sheet stack, wherein the sheet stack ejecting apparatus comprises:

an ejecting device for carrying and ejecting a sheet stack, the ejecting device holding a sheet stack with two rotating members to carry the sheet stack, wherein the sheet stack continues moving until completely ejected;

an open-close mechanism for switching states of the two rotating members by shifting at least one of the two rotating members to adjust pressing force, the open-close mechanism switching between a contact and pressing state and a contact-and-pressing free state; and a controller for controlling the open-close mechanism that controls the two rotating members to be in the contact and pressing state by the open-close mechanism when a sheet stack is ejected, and controls the two rotating members to be in the contact-and-pressing free state before a back end of the sheet stack escapes from nips of the two rotating members and to remain in the contact-and-pressing free state until the sheet stack is completely ejected.

9. An image forming apparatus according to claim 8, wherein the two rotating members are separated when the open-close mechanism controls the two rotating members to be in the contact-and-pressing free state.

10. An image forming apparatus according to claim 9, wherein the controller determines timing to separate the two rotating members by using at least one of following factors: paper size; number of sheets of paper; thickness of a sheet stack; and weight of a sheet stack.

11. An image forming apparatus according to claim 10, wherein the controller separates the two rotating members before a back end of a sheet of paper escapes from nips of the two rotating members only in case the paper size is a predetermined size or smaller.

12. An image forming apparatus according to claim 10, wherein the controller separates the two rotating members earlier as the number of sheets increases.

13. An image forming apparatus according to claim 12, wherein the controller separates the two rotating members before a back end of a sheet of paper escapes from nips of the two rotating members only in case the number of sheets is predetermined number or more.

14. A sheet stack processing apparatus comprising:

a processing tray for storing plural sheets of paper in order and making a sheet stack;

an ejecting device for carrying and ejecting a sheet stack piled on the processing tray, the ejecting device holding a sheet stack with two rotating members to carry the sheet stack, wherein the sheet stack continues moving until completely ejected;

a stack processing device for conducting stack processing to a sheet stack piled on the processing tray before the sheet stack is ejected by the ejecting device;

an open-close mechanism for switching states of the two rotating members by shifting at least one of the two rotating members to adjust pressing force, the open-close mechanism switching between a contact and pressing state and a contact-and-pressing free state; and a controller for controlling the open-close mechanism that controls the two rotating members to be in the contact and pressing state by the open-close mechanism when a sheet stack is ejected, and controls the two rotating members to be in the contact-and-pressing free state before a back end of the sheet stack escapes from nips of the two rotating members and to remain in the contact-and-pressing free state until the sheet stack is completely ejected.

15. A sheet stack processing apparatus according to claim 14, wherein the two rotating members are separated when the open-close mechanism controls the two rotating members to be in the contact-and-pressing free state.

16. A sheet stack processing apparatus according to claim 15, wherein the controller determines timing to separate the two rotating members by using at least one of following factors: paper size; number of sheets of paper; thickness of a sheet stack; and weight of a sheet stack.

17. A sheet stack processing apparatus according to claim 16, wherein the controller separates the two rotating members before a back end of a sheet of paper escapes from nips of the two rotating members only in case the paper size is a predetermined size or smaller.

18. A sheet stack processing apparatus according to claim 16, wherein the controller separates the two rotating members earlier as the number of sheets increases.

19. A sheet stack processing apparatus according to claim 18, wherein the controller separates the two rotating members before a back end of a sheet of paper escapes from nips of the two rotating members only in case the number of sheets is predetermined number or more.

20. A sheet stack processing apparatus according to claim 14, wherein the stack processing device staples a sheet stack.

* * * * *